US009495821B2

(12) United States Patent
Chow et al.

(10) Patent No.: US 9,495,821 B2
(45) Date of Patent: Nov. 15, 2016

(54) DEVICE FOR HANDLING NOTES OF VALUE

(71) Applicant: WINCOR NIXDORF INTERNATIONAL GMBH, Paderborn (DE)

(72) Inventors: Kelvin Joon Ho Chow, Singapur (SG); Rophie Rabanos Cuyos, Singapur (SG); Hengky Wirawan, Singapur (SG); Joerg Plotzitzka, Singapur (SG); Karl Seroka, Salzkotten (DE)

(73) Assignee: WINCOR NIXDORF INTERNATIONAL GMBH, Paderborn (GA)

( * ) Notice: Subject to any disclaimer, the term of this patent is extended or adjusted under 35 U.S.C. 154(b) by 0 days.

(21) Appl. No.: 14/434,125

(22) PCT Filed: Oct. 15, 2013

(86) PCT No.: PCT/EP2013/071514
§ 371 (c)(1),
(2) Date: Apr. 8, 2015

(87) PCT Pub. No.: WO2014/060403
PCT Pub. Date: Apr. 24, 2014

(65) Prior Publication Data

US 2015/0254920 A1 Sep. 10, 2015

(30) Foreign Application Priority Data

Oct. 15, 2012 (EP) ..... 12188474
Oct. 8, 2013 (EP) ..... 13187680

(51) Int. Cl.
*G07D 13/00* (2006.01)
*G07D 11/00* (2006.01)
(Continued)

(52) U.S. Cl.
CPC ..... *G07D 11/0021* (2013.01); *B65H 29/58* (2013.01); *B65H 29/62* (2013.01);
(Continued)

(58) Field of Classification Search
CPC ..... B65H 2701/1912; G07D 7/00; G07D 11/0021; G07D 11/0033; G07D 11/0084; G07F 19/202; G07F 19/203; G07F 19/205
USPC ..... 194/206, 207, 344, 350; 271/3.01, 3.14
See application file for complete search history.

(56) References Cited

U.S. PATENT DOCUMENTS 4,618,302 A * 10/1986 Kokubo ..... B65H 29/40 271/212
7,422,118 B2 * 9/2008 Ugo ..... B65H 31/24 194/206
2009/0166957 A1 * 7/2009 Kong ..... B65H 31/3009 271/198

FOREIGN PATENT DOCUMENTS

DE 10 2007 060 803 6/2009
DE 10 2009 042 383 3/2011
(Continued)

OTHER PUBLICATIONS

International Appl. No. PCT/EP2013/071514—International Preliminary Report on Patentability—Issued on May 7, 2015, (8 pages).
(Continued)

*Primary Examiner* — Mark Beauchaine
(74) *Attorney, Agent, or Firm* — Gerald E. Hespos; Michael J. Porco; Matthew T. Hespos

(57) ABSTRACT

A device (10) for handling notes of value has a box receiving area (14) for receiving cash boxes (18) and a first transport unit (22) for transporting of notes of value between the cash boxes (18) and a head module (12). A first switch (50) is provided at a head module side-end of the first transport unit (22). Further, the device (10) has a stacking unit (26), an input and/or output compartment (28) and a reject and retract container (30). In addition, a second transport unit (24) for transporting notes of value between the stacking unit (26), the input and/or output compartment (28) and the reject and retract container (30) is provided. In a first switch position, the first switch (50) guides a note of value removed from the box receiving area (14) to the stacking unit (26) and in a second switch position to the second transport unit (24).

25 Claims, 10 Drawing Sheets

(51) Int. Cl.

| | |
|---|---|
| ***G07D 7/12*** | (2016.01) |
| ***G07F 19/00*** | (2006.01) |
| ***B65H 29/58*** | (2006.01) |
| ***B65H 29/62*** | (2006.01) |
| ***B65H 31/02*** | (2006.01) |
| ***B65H 31/30*** | (2006.01) |

(52) U.S. Cl.

CPC ..... *B65H 31/02* (2013.01); *B65H 31/3027* (2013.01); *B65H 31/3063* (2013.01); *G07D 7/12* (2013.01); *G07D 11/0033* (2013.01); *G07D 11/0081* (2013.01); *G07D 11/0084* (2013.01); *G07F 19/202* (2013.01); *G07F 19/203* (2013.01); *B65H 2403/942* (2013.01); *B65H 2404/1114* (2013.01); *B65H 2404/261* (2013.01); *B65H 2404/631* (2013.01); *B65H 2408/13* (2013.01); *B65H 2701/182* (2013.01); *B65H 2701/1912* (2013.01)

(56) References Cited

FOREIGN PATENT DOCUMENTS

| | | |
|---|---|---|
| DE | 10 2010 004 580 | 7/2011 |
| DE | 10 2010 037 316 | 3/2012 |
| DE | 10 2011 000 785 | 8/2012 |

OTHER PUBLICATIONS

International Search Report of Jan. 14, 2014, PCT/EP2013/071514 (12 pages).

* cited by examiner

DEVICE FOR HANDLING NOTES OF VALUE

BACKGROUND

1. Field of the Invention

The invention relates to a device for handling notes of value, which comprises a box receptacle for receiving cash boxes and a head module. In the head module, a stacking unit for stacking the notes of value removed from the cash boxes into a wad of value notes, an input and/or output compartment for the input and/or output of notes of value, and a reject and retract container for receiving rejected and non-removed notes of value is provided.

2. Description of the Related Art

In known devices for handling notes of value, such as known automated teller machines, the notes of value removed from the cash boxes are first intermediately stored in an intermediate storage unit until all notes of value determined for the withdrawal have been removed from the cash boxes. The intermediate storage units are often designed in the form of drum storages. The intermediate storage is implemented so that in case multiple pull-offs occur during the removal of the notes of value or the removed notes of value cannot be paid out for another reason and have to be sorted out (so-called rejects) no incorrect amount of money is paid out. When a reject case occurs, the notes of value intermediately stored in the intermediate storage unit are transported to a reject container and the putting together of the notes of value of the value note wad to be paid out is started again. Only after all notes of value have been removed from the value note container as planned and have been fed to the intermediate storage unit, these are again removed from the intermediate storage unit and are stacked in a stacking unit into a value note wad to be output.

What is problematic with such devices is that much installation space is required for the intermediate storage unit, which space is generally limited in automated teller machines and is thus not available for other components parts. Further, the intermediate storage of the notes of value slows down the withdrawal operation.

It is the object of the invention to specify a device for handling notes of value, by means of which value note wads can be output in an easy manner and within a short time.

This object is solved by a device having the features of claim 1. Advantageous developments of the invention are specified in the dependent claims.

SUMMARY OF THE INVENTION

According to the invention a first transport unit for the transport of notes of value between the box receiving area and the head module is provided. At the head module-side end of the first transport unit a first switch is arranged. Further, a second transport unit is arranged within the head module for the transport of notes of value, by means of which notes of value and value note wads are transportable between the stacking unit, the input and/or output compartment and the reject container. The first switch is designed such that in a first switch position a note of value removed from a box and transported via the first transport unit is feedable to the stacking unit. In a second switch position, on the other hand, the first switch feeds the note of value removed from a box directly to the second transport unit.

Thus, it is achieved that the notes of value which are removed from the cash boxes and which are to be sorted out, for example due to the occurrence of a double pull-off, i.e. so-called rejects, can directly be fed to the second transport unit and via this unit directly to the reject and retract container. The notes of value considered to be good, i.e. the non-rejected notes of value, on the other hand, are fed via the first switch to the stacking module and are thus stacked into a value note wad. Thus, it is altogether achieved that an intermediate storage unit can be dispensed with because the rejected notes of value can directly be fed to the reject and retract container independent of the notes of value in the stacking module which are actually used for withdrawal. As an intermediate storage unit is dispensed with, thus the installation space required for this unit can be saved. Further, costs are likewise saved and the time required for withdrawal is reduced. In addition, the notes of value transported to the stacking module before the notes of value to be rejected can still be used for withdrawal.

It is advantageous when the second transport unit is designed such that by means of it both value note wads and individual notes of value are transportable. Thus, by means of the second transport unit the value note wad stacked by the stacking unit can be transported to the input and/or output compartment or, if necessary, to the reject and retract container. Likewise, the second transport unit also makes it possible that the individual notes of value already sorted out during the removal from a cash box can directly be fed to the reject and retract container. Thus, a particularly simple compact structure is achieved since only one transport unit is required for the transport in the head module downstream of the first transport unit.

Further, it is advantageous when the stacking unit is designed such that a value note wad stacked therein is feedable from the stacking unit directly to the second transport unit. By direct feeding it is in particular meant that the value note wad does not have to be first fed from the second stacking unit to the first transport unit and via this unit then to the second transport unit but is transferred from the stacking unit to the second transport unit without a further transport unit. Thus, a transport path as short as possible is realized, and the first transport unit can be constructed particularly easily as by means of it only individual notes of value have to be transported.

For this, the stacking unit in particular comprises a pivotable support element which is movable between a feed position and a removal position. Here, the feed position is the position in which the support element is arranged when notes of value are fed to the stacking unit and are stacked into the value note wad. For this, in particular the note of value that has been fed first rests on the support element and the further fed notes of value then rest on said first note of value. The removal position, on the other hand, is the position in which the support element is arranged for the transfer of the value note wad to the second transport unit. In particular, a drive unit, preferably a direct current motor, is provided, by means of which the support element is pivoted by a predetermined angle about an axis of rotation between the feed position and the transfer position. Thus, a particularly simple and compact structure is achieved.

The reject and retract container in particular comprises a first compartment for receiving rejected notes of value (so-called rejects) and a second compartment separate from the first compartment for receiving notes of value not removed from the input and/or output compartment (so-called retracts). Thus, the rejects and retracts can be stored separately, which may be important for the fulfillment of legal standards for note tracking. The reject and retract container is in particular designed in the form of a cash box so that the rejects and retracts can easily be removed.

The second transport unit preferably comprises a second switch for feeding notes of value transported by means of the second transport unit to the reject and retract container. In a first switch position, the second switch is in particular arranged such that notes of value transported along the reject and retract container by means of the second transport unit are not fed to the reject and retract container and thus can in particular be transported between the stacking unit and the input and/or output compartment. In the second switch position, on the other hand, the second switch is designed such that notes of value transported along the reject and retract container by means of the second transport unit can be deflected from the transport path and can be fed to the reject and retract container.

In a particularly preferred embodiment, both rejected notes of value (rejects) and notes of value not removed from the input and/or output compartment (retracts) are feedable to the reject and retract container by means of the second switch. Thus, in the transport path of the second transport unit, only one single switch for deflecting both rejects and retracts has to be provided. In this embodiment, in particular a third switch is provided within the reject and retract container, by means of which third switch the notes of value fed via the second switch can then be distributed to the first and the second compartment. Thus, a particularly compact simple structure is achieved since within the head module itself only one switch, namely the second switch, has to be provided and the separation of the rejects and retracts takes place in the reject and retract container.

In an alternative embodiment of the invention, the second switch can also be designed such that by means of it only rejected notes of value removed from the cash boxes (rejects) are feedable to the first compartment. In this case, the second transport unit comprises a fourth switch for feeding notes of value not removed from the input and/or output compartment (retracts) to the second compartment.

The stacking unit is in particular arranged in a first end region of the second transport unit and the input and/or output compartment is arranged in a second end region of the second transport unit opposite to the first end region. The reject and retract container is arranged between the stacking unit and the input and/or output compartment along the transport path of the second transport unit. Thus, all required transport operations of the notes of value and the value note wads can be carried out via the second transport unit. In particular, by means of the second transport unit the notes of value rejected during the removal from the cash boxes can individually be fed to the reject and retract container. Likewise, the value note wad can be transported from the stacking unit via the second transport unit to the input and/or output compartment. Further, it is also possible that the entire value note wad, when it had been sorted out, is fed to the reject and retract container. In addition, the second transport unit also enables the transport of value note wads not removed from the input and/or output compartment (retracts) to the reject and retract container.

The second transport unit comprises at least one belt guided over at least one drivable idler element. The idler element is in particular a pulley which can be driven via a drive unit, such as an electric motor.

The belt is preferably driven in a first direction of rotation for the transport of notes of value from the stacking unit to the input and/or output compartment, for the transport of individual rejected notes of value removed from the cash boxes to the reject and retract container and for the transport of a rejected value note wad from the stacking unit to the reject and retract container. On the contrary, the belt is in particular driven in a second direction of rotation opposite to the first direction of rotation for the transport of notes of value not removed from the input and/or output compartment to the reject and retract container. Thus, all required transports can be carried out by means of a simple inversion of the direction of rotation of the belt.

Further, it is advantageous when the second transport unit comprises a receiving unit for receiving the value note wad for the transport of the value note wad from the stacking unit to the input and/or output compartment and/or to the reject and retract container. This receptacle is, for example, designed in the form of a counter-pressure element which is attached to the belt and moves the individual notes of value or the value note wad in the transport direction in that it presses against the edges of the notes of value.

The first and second transport units are in particular designed such that in a transfer area at the head module-side end of the first transport unit notes of value can directly be transferred from the first transport unit to the second transport unit.

In a particularly preferred embodiment the second transport unit comprises a sliding plate for the transport of the value note wad from the stacking unit to the input and/or output compartment and/or to the reject and retract container. Here, the sliding plate is movable along the transport path of the value note wad and presses against the edges of the notes of value of the value note wad for the transport of the value note wad so that the value note wad is moved hereby. Here, the sliding plate in particular presses against the rear edge of the notes of value of the value note wad, as viewed in the transport direction of the value note wad.

By means of such a sliding plate it is achieved that no notes of value can get lost during the transport. When value note wads are transported via double belt arrangements there is the risk that individual notes of value, in particular such which have a lower friction with respect to their neighboring notes of value, are transported at a slower speed and thus gradually fall behind relative to the other notes of value. By means of the sliding plate, such notes of value which fall behind are kept from falling behind. Thus, a particularly safe transport of the notes of value of the value note wad is achieved. The sliding plate is in particular movable from the stacking unit up into the input and/or output compartment. As a result, it is achieved that the value note wad is supported by the sliding plate during its entire transport or it is at least prevented by means of the sliding plate that individual notes of value slip out backward.

The second transport unit preferably comprises at least one double belt arrangement for the transport of value note wads, the double belt arrangement comprising at least one first belt and one second belt, between which the value note wads are arranged for the transport. The individual belts are in particular guided over pulleys, wherein for each belt at least one of the pulleys over which it is guided is drivable by means of a drive unit. Thus, the notes of value received between the belts are moved together with the belts in the direction of movement of the belts, i.e. the transport direction.

The double belt arrangement in particular comprises not only two but four belts, wherein a third belt is arranged parallel to the first belt and a fourth belt is arranged parallel to the second belt, each time at a predetermined distance to them. Thus, the notes of value are guided over a broader surface so that a safer transport is guaranteed.

When transported from the stacking unit to the input and/or output compartment, the value note wad is preferably driven at least over a partial distance both by the double belt arrangement and by the sliding plate so that by means of this double guidance via the double belt arrangement and the sliding plate a particularly safe transport can be accomplished and a loss of notes of value is prevented.

In a particularly preferred embodiment this transport takes place both via the double belt arrangement and the sliding plate over the entire distance between the stacking unit and the input and/or output compartment.

In an alternative embodiment of the invention the sliding plate can also be moved at a predetermined distance behind the rear edge of the value note wad, as viewed in the direction of transport of the value note wad. As a result, it is achieved that when individual notes of value fan out from the value note wad, these are "caught" by the sliding plate and are thus kept within the value note wad.

The belts of the double belt arrangement and the sliding plate are in particular moved in the transport direction at the same speed so that the relative arrangement between the value note wad received between the belts of the double belt arrangement and the sliding plate is constant.

In a preferred embodiment, the sliding plate is movable independent of the belts of the double belt arrangement, i.e. that the sliding plate can be moved relative to the belts of the double belt arrangement. In particular, the sliding plate is not attached to the belts of the double belt arrangement.

In a preferred embodiment, the sliding plate is attached to a third belt, this third belt being drivable by means of a first drive unit. The belts of the double belt arrangement are, on the other hand, drivable by means of a second drive unit different from the first drive unit. As a result, it is achieved that the sliding plate can be moved easily at a different speed independent of the belts of the double belt arrangement. Thus, the sliding plate, as still explained in more detail in the following, can also be used for other purposes than only for the protection of the value note transport.

In a preferred embodiment, the sliding plate is moved during the transport of a value note wad from the stacking unit to the input and/or output compartment at a higher speed in the direction of the input and/or output compartment than the belts of the double belt arrangement. In this way, a fanning out of the value note wad opposite to the direction of transport, i.e. in the direction of the sliding plate, is prevented as the notes of value always rest against the sliding plate.

Likewise, it is advantageous when the sliding plate is moved during the transport of a value note wad from the input and/or output compartment in the direction of the stacking unit at a slower speed in the direction of the stacking unit than the belts of the double belt arrangement. As a result, it is also guaranteed that the notes of value of the value note wad rest against the sliding plate and thus a fanning-out is prevented.

When a value note wad is offered to a customer for withdrawal via the input and/or output compartment, the sliding plate is in particular moved such that it is arranged behind the value note wad, as viewed from the viewing direction of the customer. As a result, access to the transport path along which the value note wad is transported from the stacking unit to the input and/or output compartment is closed. In particular, the insertion of manipulation units, such as fork-shaped clamps for holding the notes of value, is prevented.

In a particularly preferred embodiment the device comprises a control unit which for controlling the input and/or output compartment drives the second transport unit such that the sliding plate is moved into the input and/or output compartment. By means of this movement of the sliding plate into the input and/or output compartment it can be checked whether a manipulation unit, such as a clamp, has been inserted into the input and/or output compartment. If the sliding plate can be moved as planned without any collision, then it is assumed that there is no manipulation attempt, i.e. that no unit has been inserted into the input and/or output compartment in an unauthorized manner. If, on the other hand, the sliding plate cannot be moved into the input and/or output compartment as planned, then a manipulation attempt is assumed and in particular a fault message is output and/or the device is shut down.

A further aspect of the invention relates to a device for handling notes of value, which comprises a stacking unit for stacking notes of value into a value note wad to be output, and an input and/or output compartment for the output and/or input of notes of value. Further, the device has a transport unit for the transport of notes of value between the stacking unit and the input and/or output compartment. This stacking unit comprises a double belt arrangement for the transport of the value note wad, the double belt arrangement comprising at least one first belt and one second belt, between which the value note wad is received for transport. Further, the device has a sliding plate for the transport of the value note wad from the stacking unit to the input and/or output compartment, the sliding plate pressing against the edges of the notes of value of the value note wad for the transport of the value note wad so that the value note wad is moved. Here, the sliding plate is in particular movable from the stacking unit up into the input and/or output compartment.

By means of this combination of a double belt transport and a sliding plate it is achieved that notes of value of the value note wad which, due to low friction, are transported slower in the transport direction of the double belt arrangement and thus slowly run out backward from the actual value note wad are kept from completely sliding out of the value note wad by means of the sliding plate. Thus, a loss of these notes of value is prevented.

By the movability of the sliding plate between the stacking unit up into the input and/or output compartment it is achieved that this protection function against the loss of notes of value is provided over the entire transport path. In addition, by moving the sliding plate into the input and/or output compartment access to the transport path by unauthorized people is prevented. Further, it can be checked as a result thereof whether a manipulation unit, in particular a clamp, has been inserted into the input and/or output compartment.

The transport unit of the device for handling notes of value according to a further aspect of the invention can be further developed with the features of the second transport unit of the first aspect of the invention.

In particular, the value note wad can be moved both by the double belt arrangement and by the sliding plate at least over a partial distance during the transport from the stacking unit to the input and/or output compartment. In particular, this double guidance takes place over the entire distance.

Alternatively, the value note wad can be moved by the double belt arrangement at least over a partial distance, preferably over the entire distance, during the transport from the stacking unit to the input and/or output compartment, the sliding plate being moved at least over a partial distance at a predetermined distance behind the rear edge of the value note wad, as viewed in the transport direction of the value note wad.

The sliding plate can in particular be moved independent of the belts of the double belt arrangement so that a check of the input and/or output compartment is possible in that the sliding plate is moved thereinto.

The sliding plate is in particular attached to a third belt, this third belt being drivable by means of a first drive unit and the belts of the double belt arrangement are drivable by means of a second drive unit different from the first drive unit. In this way, the belts and thus the double belt arrangement and the sliding plate can be moved independent of each other at different speeds.

During the offering of a value note wad for removal from the input and/or output compartment, the sliding plate is arranged in particular behind the value note wad to be output in order to prevent access to the transport path.

Further, it is advantageous when the sliding unit is moved into the input and/or output compartment for control thereof. As a result, it can easily be checked whether a clamp or another manipulation device has been inserted into the input and/or output compartment in an unauthorized manner.

Further features and advantages of the invention result from the following description which explains the invention in more detail on the basis of embodiments in connection with the enclosed Figures.

DETAILED DESCRIPTION

Figure 1:
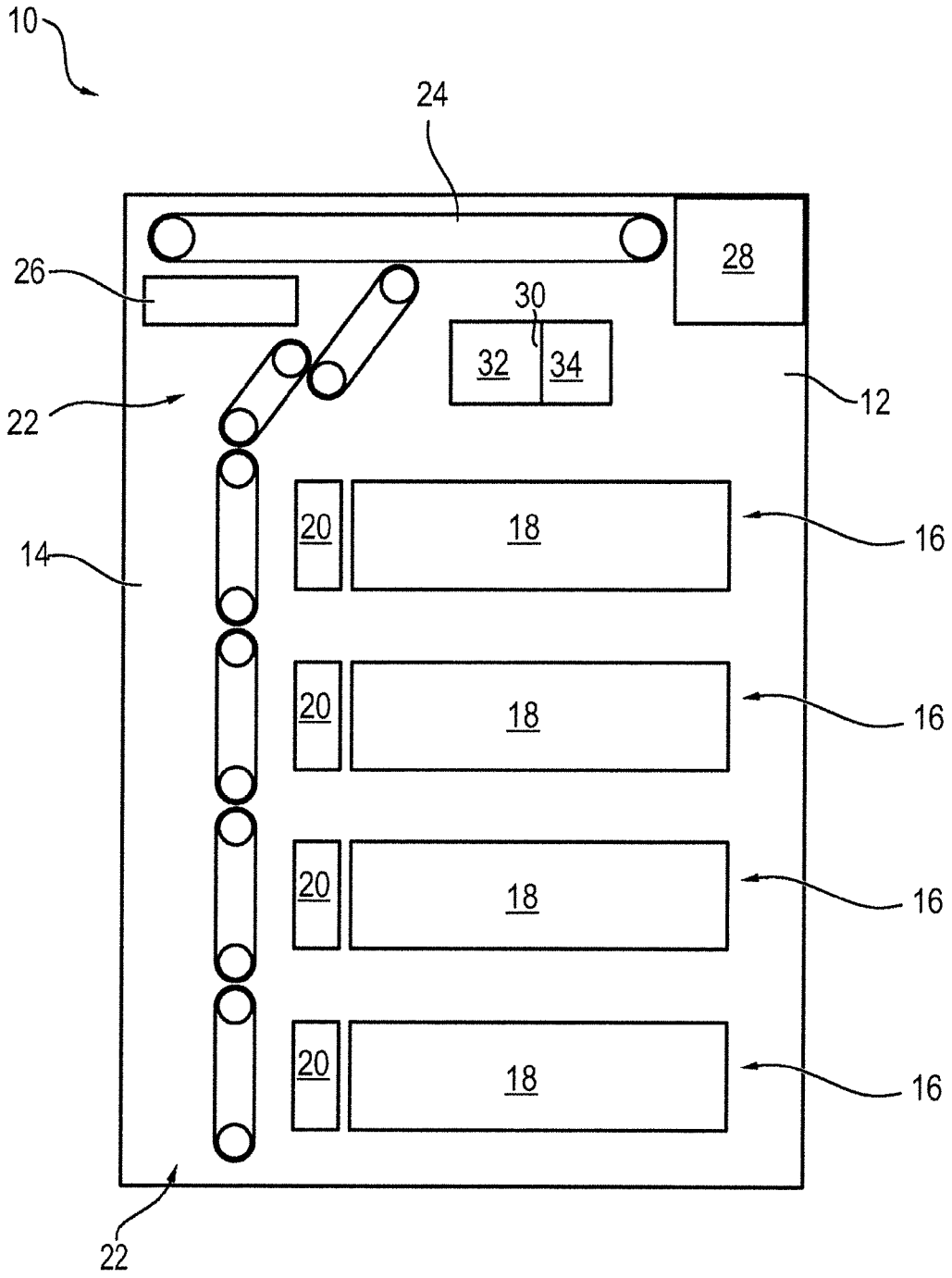
FIG. 1 shows a schematic illustration of an automated teller machine.

In FIG. 1, a schematic illustration of a device for handling notes of value designed as an automated teller machine 10 is illustrated. Alternatively, the device can also be an automatic cash safe or an automatic cash register system.

The automated teller machine 10 comprises a head module and a box area 14 in which four receiving areas 16 for receiving one cash box 18 each are provided. To each of the receiving areas 16, a pull-off module 20 for the removal of notes of value from the respective cash box 18 is assigned. Alternatively, the pull-off modules 20 can also be designed such that by means of them not only notes of value can be removed from the cash box 18 but notes of value are also feedable to the cash boxes 18.

The removed notes of value are transportable by means of a first transport unit 22 from the box area 14 into the head module 12 and further in the direction of a second transport unit 24.

In the head module 12, a stacking unit 26 is provided by means of which the notes of value removed from the cash boxes 18 can be stacked into a value note wad. The value note wad is then transported by means of the second transport unit 24 to an input and/or output compartment 28 and is offered via this compartment to a user of the automated teller machine 10 for withdrawal.

Further, in the head module 12 a reject and retract container 30 is provided which is designed in particular in the form of a cash box so that it can easily be removed. In the reject and retract container 30, on the one hand, the notes of value offered to the customer via the input and/or output compartment 28 for withdrawal but not taken out by this customer (so-called retracts) are received. On the other hand, in the reject and retract container 30 also so-called rejects are received, these being rejected notes of value which are no longer used for withdrawal. These can, for example, be notes of value which are suspected counterfeit notes of value or notes of value of a multiple pull-off, i.e. when several notes of value have simultaneously been pulled-off from a cash box 18 unintentionally.

The reject and retract container 30 comprises a first compartment 32 for receiving the rejects and a second receiving compartment 34 for receiving the retracts so that the rejects and the retracts are receivable separately.

In FIGS. 2 to 5, each time a schematic illustration of the head module 12 according to a first embodiment is illustrated, different operating states being shown in the individual Figures. In the following, at first the structure of the head module 12 is explained in more detail before then the individual operating states are described with reference to the respective Figure.

The first transport unit 22 comprises several drivable belts 36, 38, 40 which are guided over several pulleys, one of which is exemplarily identified with the reference sign. Each time at least one of the pulleys 42 over which a belt 36 to 40 is guided is drivable by means of a drive unit, such as an electric motor, so that the respective belt 36 to 40 is likewise drivable. Further, the first transport unit 22 has several stationarily arranged guiding elements 44 which are in particular designed as guide plates. Here, the notes of value removed from the cash boxes 18 are in particular each transported between the belts 36 to 40 and the guiding elements 44 along a transport path, as indicated by the arrows 46 and 48.

At the head module side-end of the first transport unit 22, i.e. at the upper end of the first transport unit 22 in the embodiment according to FIGS. 1 to 5, a first switch 50 is provided by means of which the notes of value removed from the cash boxes 18 and transported via the first transport unit 22 are feedable to the stacking module 26. For this, a pivotable switch element 52 of the switch 50 is arranged in a first switch position such that it projects into the first transport path and deflects the notes of value transported along the first transport path in the direction of the arrow P1 from the transport path and feeds them to the stacking module 26. In a second switch position, on the other hand, the switch element 52 is arranged such that the notes of value transported along the transport path of the first transport unit 22 are not deflected from the transport path and are transported further in the direction of the second transport unit 24 and are transferred to the second transport unit 24 in a transfer area 54.

Figure 2:
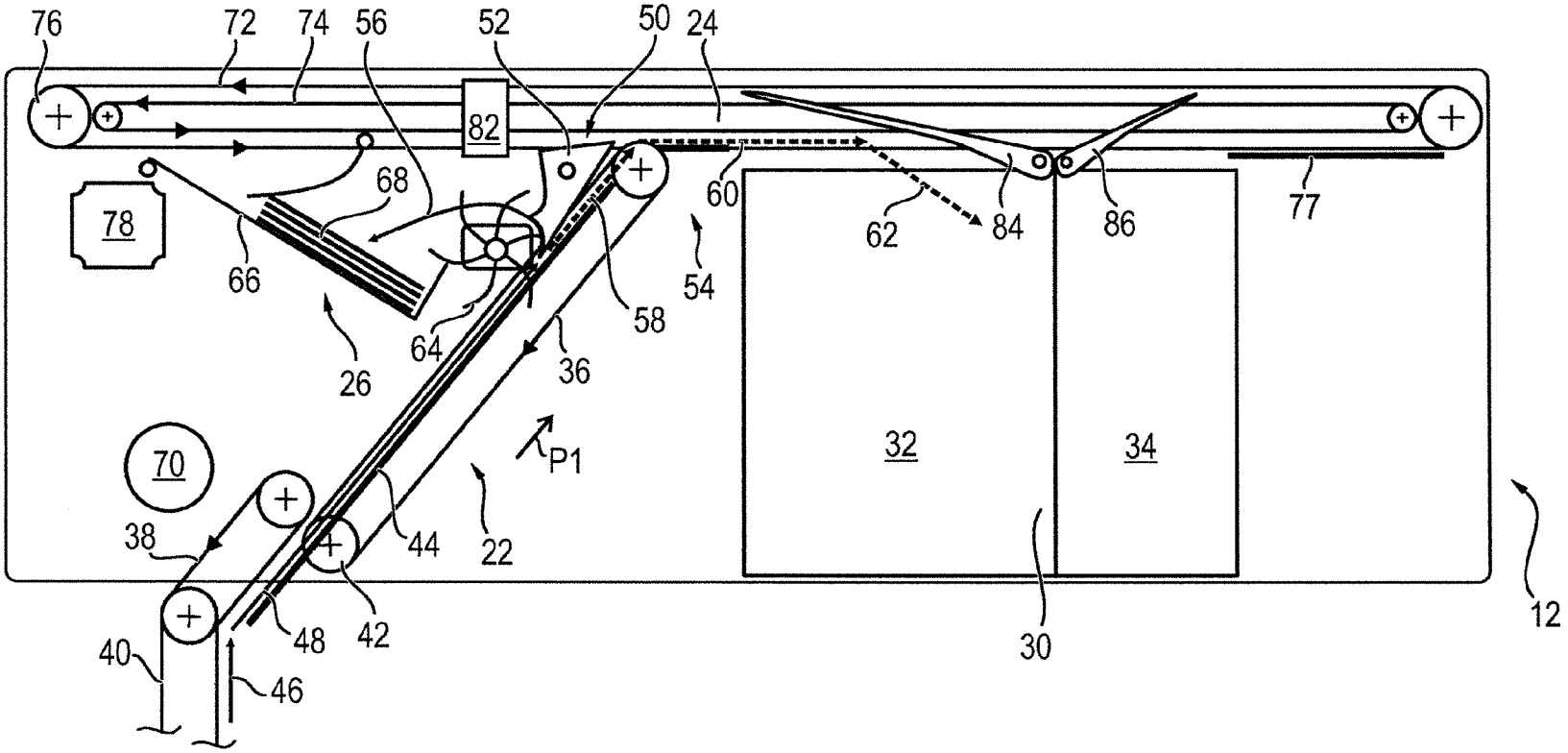
FIG. 2 shows a schematic illustration of a head module of the automated teller machine of FIG. 1 according to a first embodiment in a first operating state.
Figure 3:
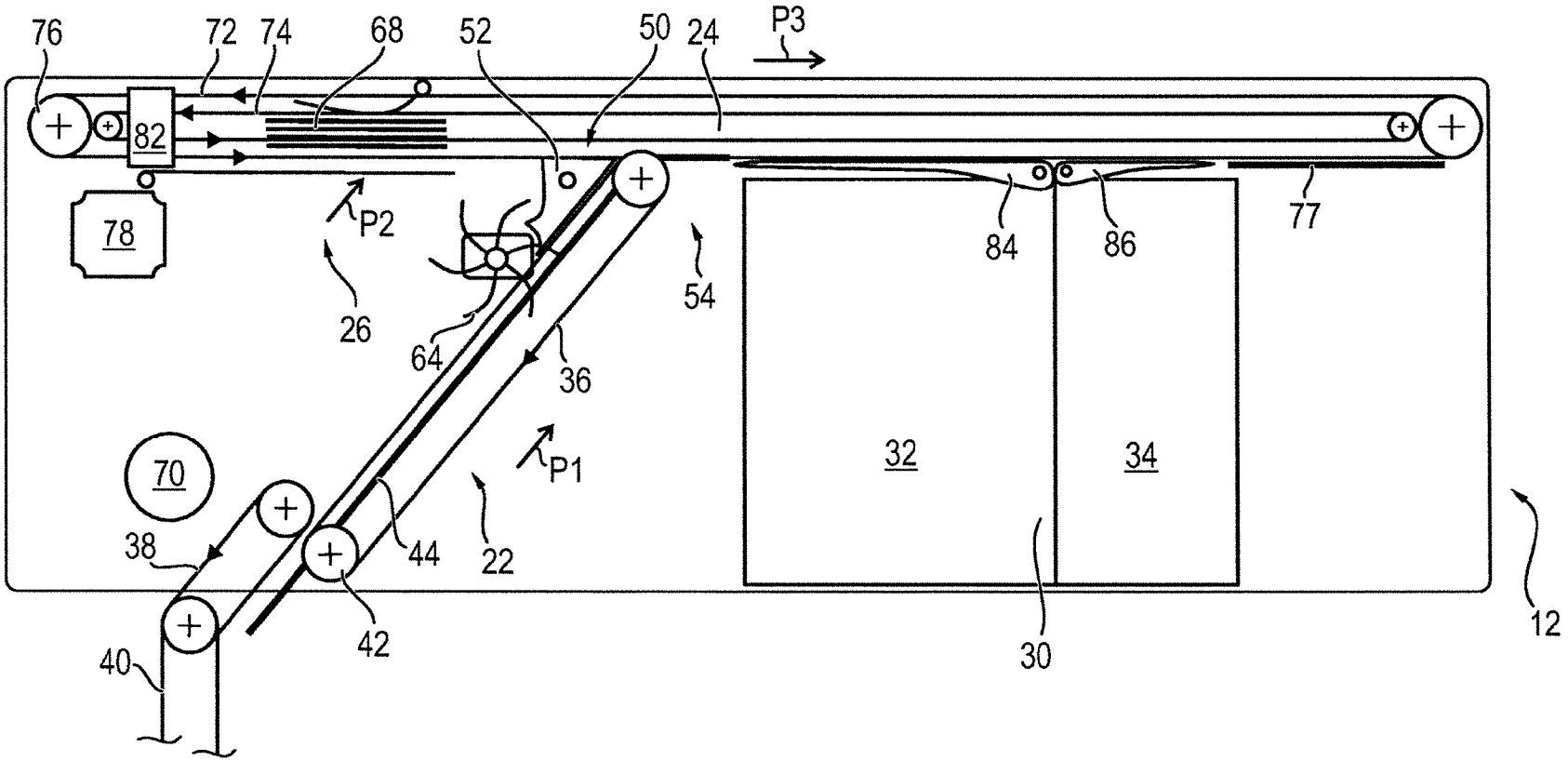
FIG. 3 shows a schematic illustration of the head module of FIG. 2 in a second operating state.

The path of the notes of value fed to the stacking module 26 and deflected via the switch element 52 arranged in the first switch position is schematically indicated by the arrow 56 in FIG. 2. The path along which those notes of value that are not fed to the stacking module 26, namely those notes of value which are sorted out as rejects, are transported, is, on the other hand, indicated by the stroked arrows 58 to 62.

The stacking module 26 comprises a paddle wheel 64 by means of which the notes of value fed thereto are stacked into a value note wad 68 on a support surface 66. During stacking of the notes of value, this support element 66 is arranged in a feed position, as shown in FIG. 2. The support element is pivotable in the direction of the arrow P2 by means of a drive unit 70 from this feed position into a removal position shown in FIG. 3.

The second transport unit 24 is designed such that by means of it both a value note wad 68 and individual notes of value are transportable. The transport unit 24 likewise comprises several belts 72, 74 and guiding elements 77 between which the notes of value are transportable. The belts 72, 74 are guided over several pulleys 76, of which at least one is drivable by means of a drive unit 78. A receiving unit 82 for receiving the value note wad 60 to be transported is provided on the belt, by means of which receiving unit the value note wad 68 is transportable in the direction of the input and/or output compartment 28.

Further, the second transport unit 24 comprises a second switch 84 by means of which a note of value transported through this transport unit 24 is feedable to the first compartment 32 of the reject and retract container 30. In addition, a fourth switch 86 is provided by means of which notes of value not removed from the input and/or output compartment 28, so-called retracts, are feedable to the second compartment 34. For this, the second switch 84 and the fourth switch 86 are in particular movable between two switch positions each in particular by means of a drive unit.

In FIG. 2, the operating state is illustrated in which the device 10 is operated while a value note wad 68 is put together for withdrawal. Here, the corresponding notes of value are removed from the cash boxes 18 via the first transport unit 22 and transported in the direction of the stacking module 26. The occurrence of multiple pull-offs is monitored by means of sensors. Further, the authenticity and/or identity of the removed notes of value can be controlled by means of corresponding sensors. As long as no abnormalities occur, the notes of value removed from the cash boxes 18, as illustrated by the arrow 56, are fed to the stacking unit 26 by means of the first switch 50 and stacked into the value note wad 68. If, however, a note of value is sorted out, then it is transferred via the first switch 50 in the transfer area 54 to the transport unit 24 and transported by the transport unit 24 to the reject and retract container 30, where it is fed to the first compartment 32 via the second switch 84.

As a result, it is achieved that the rejects can directly be sorted out, without, as in the case of known devices, having to be intermediately stored in an intermediate storage unit together with all other removed notes of value, before, in case no reject occurred, all notes of value intermediately stored in the intermediate storage device, are combined to a value note wad 60 via the stacking module 26, which wad is then offered for withdrawal via the input and/or output compartment 28. Thus, a particularly simple, cost-efficient and space-saving structure and a quick withdrawal are realized.

After all notes of value determined for the withdrawal are put together to the value note wad 68, the support element 66 of the stacking unit 26 is pivoted from the feed position into the removal position by the drive unit 70. In this removal position, the value note wad 68 can then, as shown in the second operating state in FIG. 3, be transported to the input and/or output compartment 28 by means of the second transport unit 24 and can be output to a customer via this compartment. In this second operating state, the second switch 84 and the fourth switch 86 are arranged such that no notes of value are deflected by them into the reject and retract container 30 so that the value note wad 68 can be transported in the direction of the arrow P3 by means of the second transport unit 24.

Figure 4:
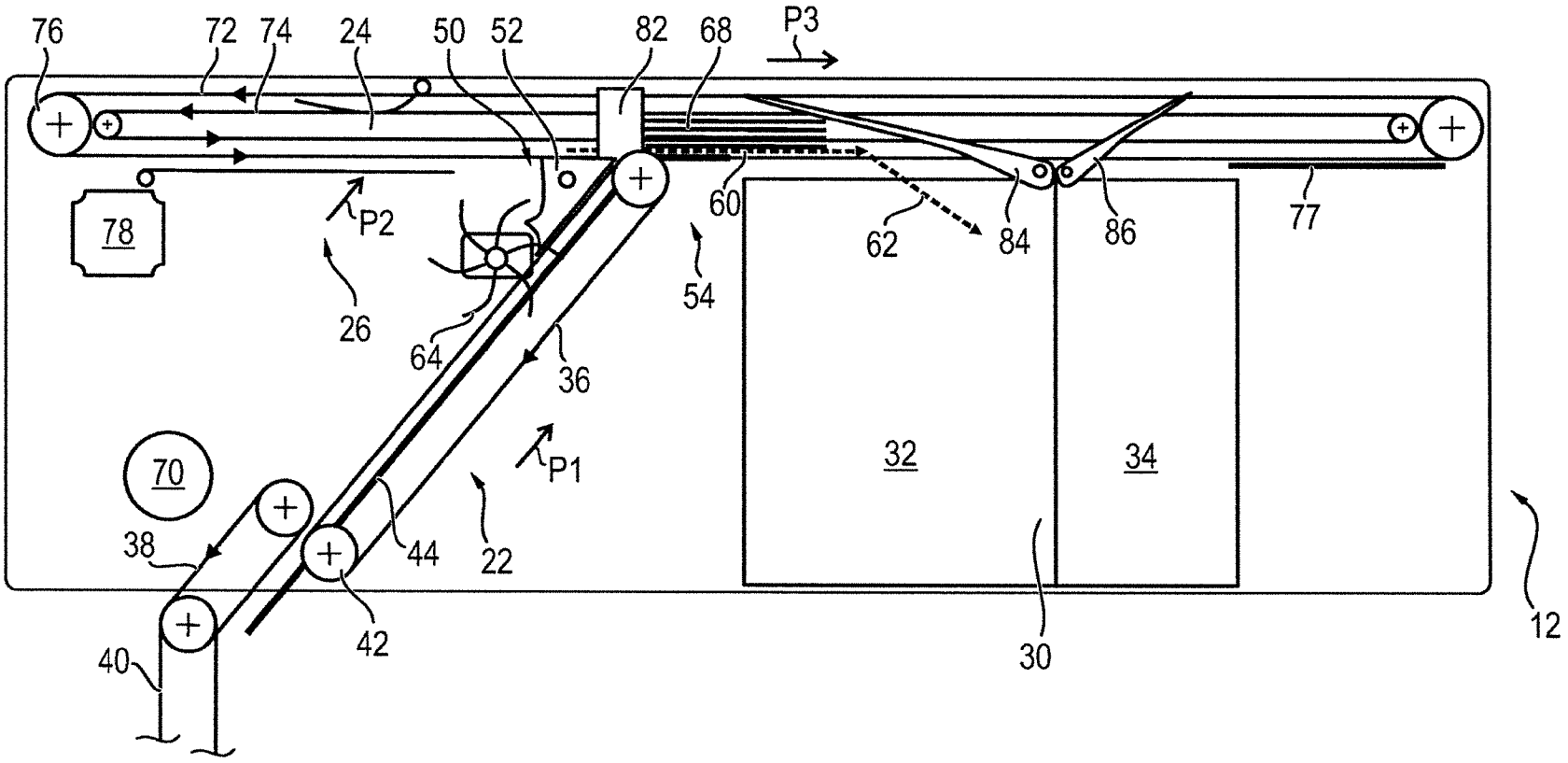
FIG. 4 shows a schematic illustration of the head module of FIGS. 2 and 3 in a third operating state.

In FIG. 4, the operating state is shown in which the entire value note wad 68 is sorted out and thus has to be fed to the first compartment 32 of the reject and retract container 30. In this case, the second switch 84, as in the case of sorting out the individual notes of value in the first operating state, is arranged in that switch position in which the notes of value transported along the transport path of the second transport unit are deflected into the first compartment 32. As indicated in FIG. 4 by the arrow 62, thus also the value note wad 68 transported in the direction of the arrow P3 is deflected and thus sorted out.

Figure 5:
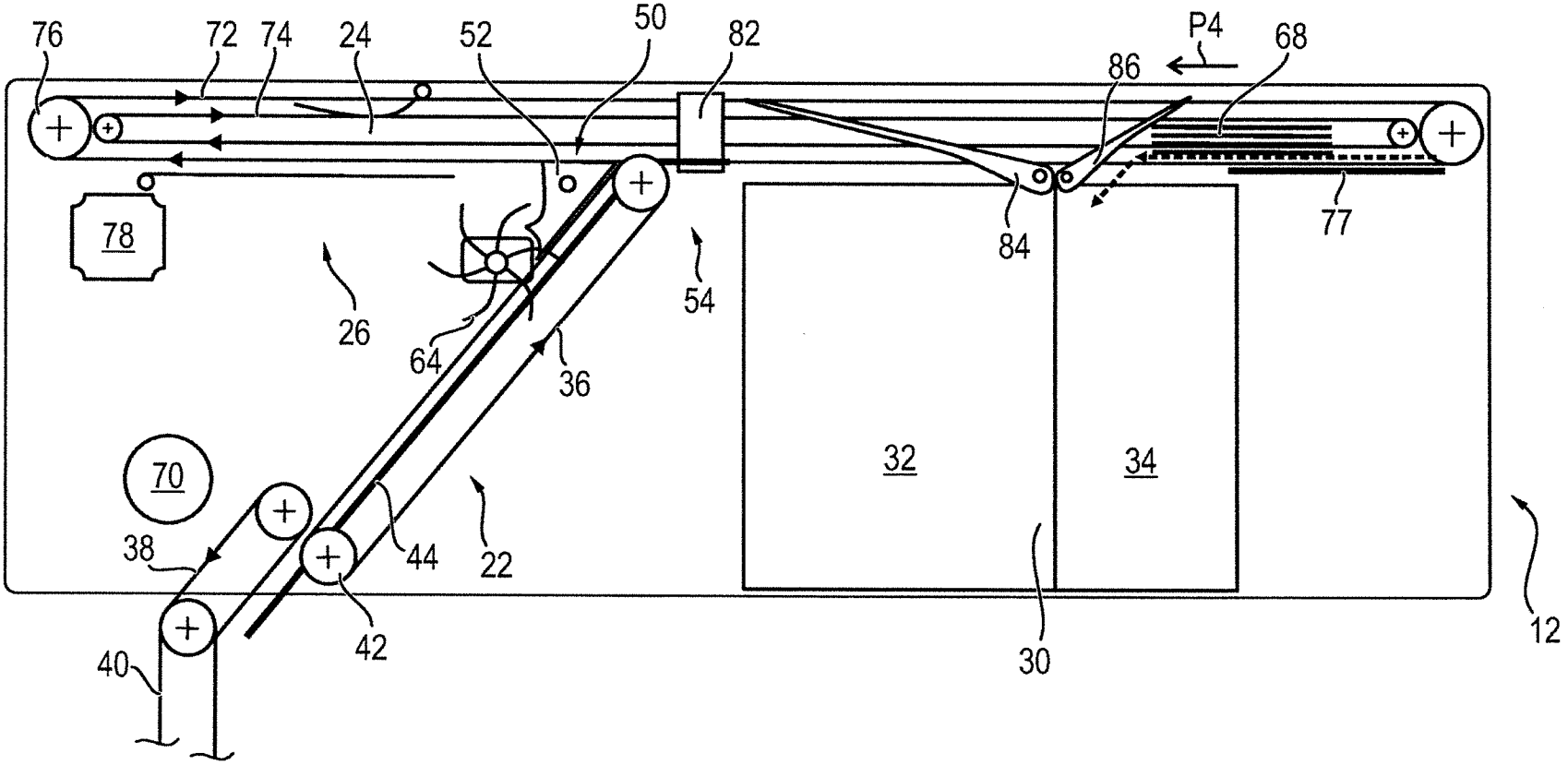
FIG. 5 shows a schematic illustration of the head module of FIGS. 2 to 4 in a fourth operating state.

In FIG. 5, a fourth operating state is illustrated which shows the retract case. If the value note wad 68 offered via the input and/or output compartment 28 has not been taken out, then the transport unit 24 is driven in opposite direction in the direction of the arrow P4 so that the value note wad 68 is likewise transported in the direction of the arrow P4. In this operating state, the fourth switch 86 is arranged such that it deflects the value note wad 68 transported via the second transport unit 24 in the direction of the arrow P4 out of the transport path of the second transport unit 24 and feeds it to the second compartment 34 of the reject and retract container 30.

Thus, altogether all required transport operations are carried out by means of the second transport unit 24, without further transport units being required. Thus, a particularly easy and fast handling of the individual notes of value and of the value note wads 68 is achieved.

Figure 6:
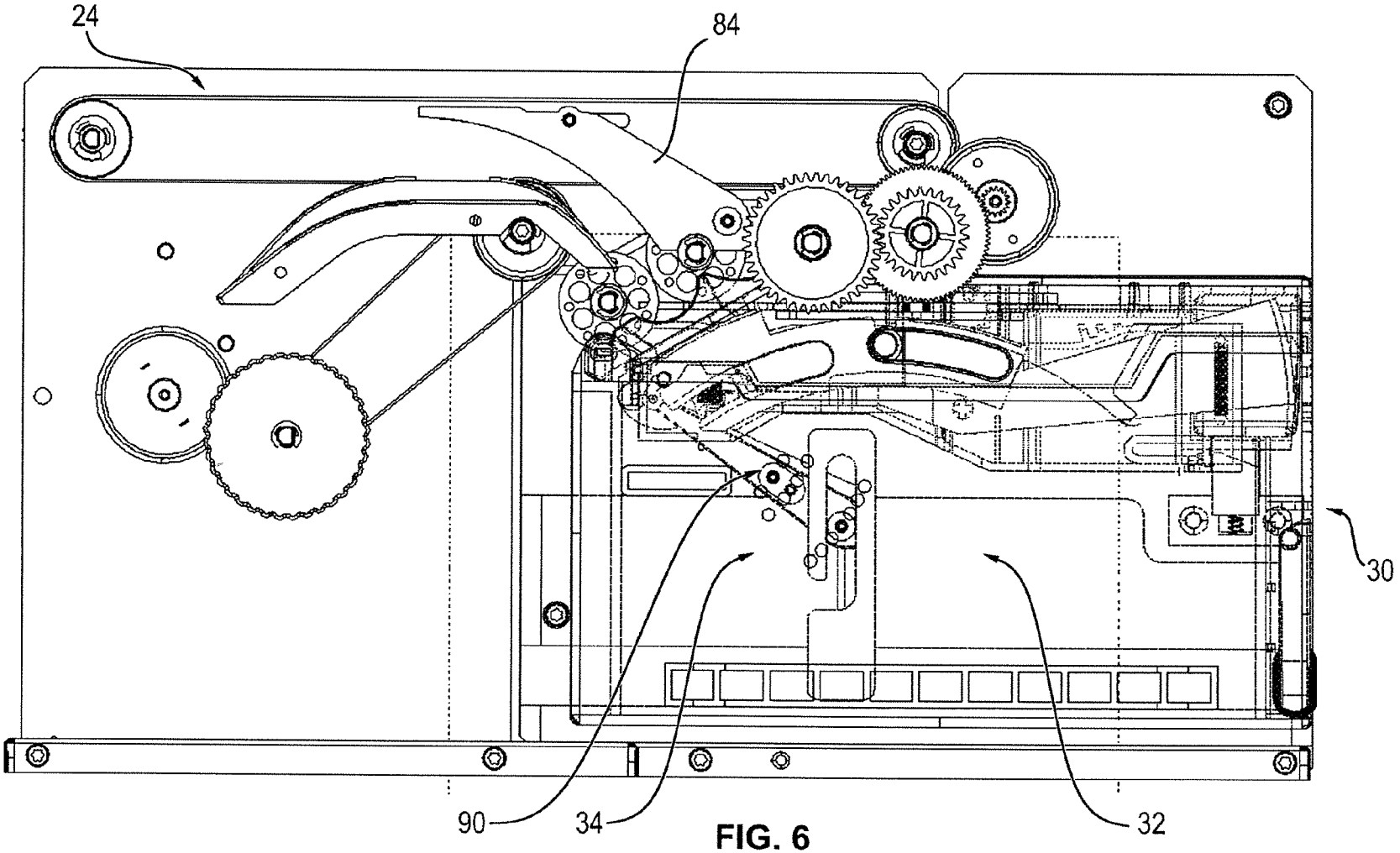
FIG. 6 shows a schematic illustration of a head module according to a second embodiment.

In FIG. 6, a schematic illustration of a head module according to a second embodiment is illustrated. The basic difference between this second embodiment and the first embodiment is that in the second embodiment the second transport unit 24 only comprises one switch 84 by means of which both the rejects and the retracts are fed to the reject and retract container 30. In this embodiment, within the reject and retract container 30 a third switch 90 is provided by means of which then the rejects and retracts are distributed to the first compartment 32 and the second compartment 34. Thus, the second transport unit 24 can be constructed even simpler and more compact.

Figure 7:
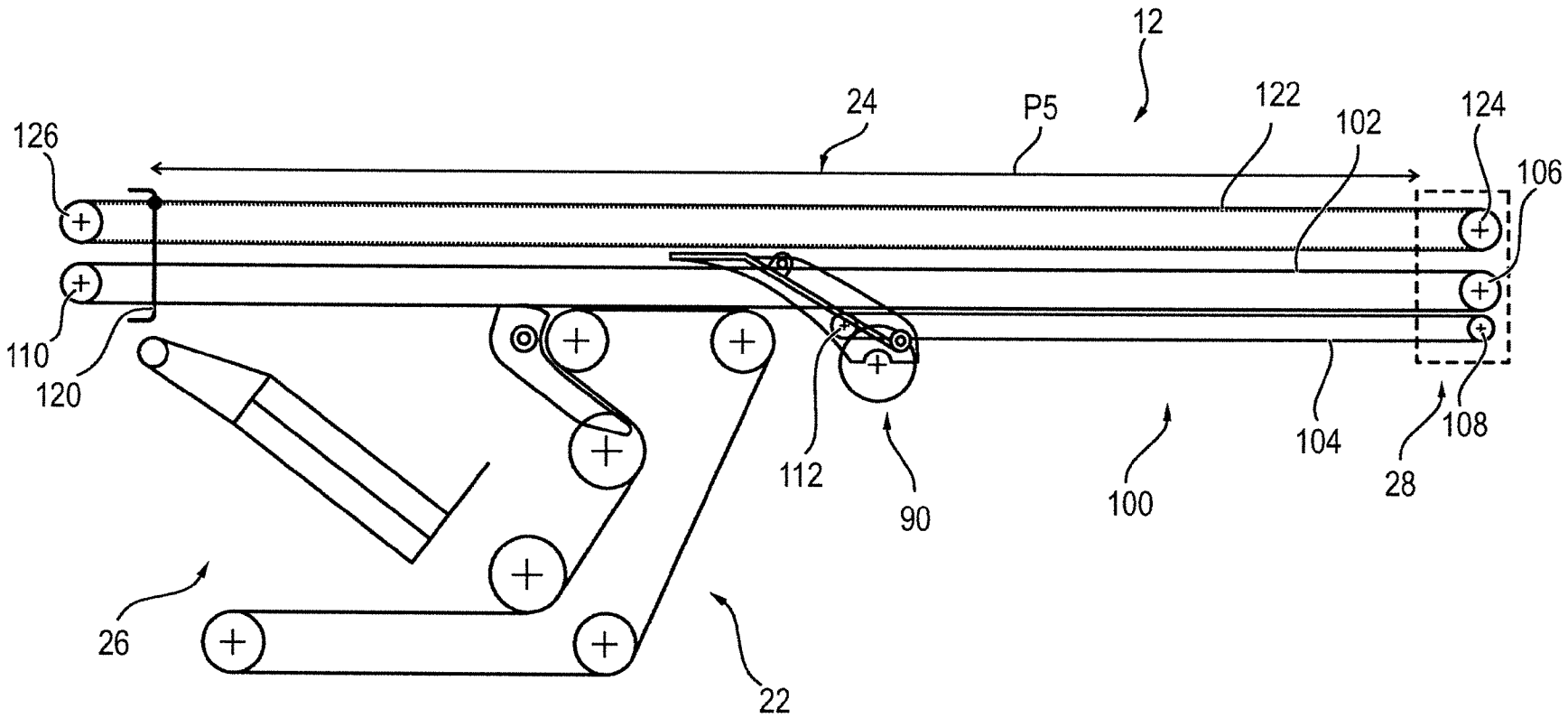
FIG. 7 shows a schematic illustration of a head module according to a third embodiment.

In FIG. 7, a schematic illustration of a head module according to a third embodiment is illustrated. The basic difference between this third embodiment and the other two embodiments is the way in which the second transport unit 24 is designed.

The second transport unit 24 comprises a double belt arrangement 100 comprising a first belt 102 and a second belt 104, each of which being guided over two pulleys 106 to 112. Of each belt 102, 104, at least one pulley 106 to 112 is drivable by means of a non-illustrated drive unit so that the belts 102, 104 can be driven.

Further, the second transport unit 24 comprises a sliding plate 120 which, as indicated by the arrow P5, is movable along the entire path between the stacking unit 26 and the input and/or output compartment 28. Here, the sliding plate 120 can be moved independent of the belts 102, 104 of the double belt arrangement 100. In particular, a third belt 122 is provided which is guided over pulleys 124, 126, at least one of which is drivable by means of a further drive unit. Thus, the third belt 122 is driven by another drive unit than the belts 102, 104 of the double belt arrangement 100 so that the sliding plate 120 can be moved independent of the belts 102, 104 of the double belt arrangement 100.

After the notes of value have been stacked into a value note wad 68 by means of the stacking unit 26, the support element 66 is pivoted upward. By means of the sliding plate 120, the notes of value of the value note wad 68 are moved in the direction of the double belt arrangement 100 and thus also in the direction of the input and/or output compartment 28 in that the sliding plate 120 is pressed against the rear edges of the notes of value of the value note wad 68, as viewed in the transport direction. As a result, the value note wad 68 is received between the belts 102, 104 of the double belt arrangement 100. By correspondingly driving the belts 102, 104, thus the value note wad 68 is moved in the direction of the input and/or output compartment 28. In addition, also the sliding plate 120 is moved behind the value note wad 68 in the direction of the input and/or output compartment 28. As a result, it is achieved that the slipping out of notes of value of the value note wad 68 backward, i.e. that these notes of value are moved slower in the transport direction than the other notes of value of the value note wad 68, is prevented by the sliding plate 120 so that these cannot fall out of the value note wad 68 at least not completely and thus a loss of notes of value is prevented. Here, the sliding plate 120 can either be moved directly behind the wad 68, i.e. that the plate 120 presses against the rear edges of the notes of value of the value note wad all the time, or can be moved at a predetermined distance behind the value note wad 68. Here, the distance is dimensioned so little that it is shorter than the width of the smallest notes of value so that a falling out of these notes of value from the value note wad 68 is safely prevented.

By moving the sliding plate 120 over the entire distance between the stacking unit 26 and the input and/or output compartment 28 a loss of notes of value is prevented over the entire distance.

When the value note wad 68 is offered to a user of the device 10 for output via the input and/or output compartment 28, the sliding plate 120 is in particular moved behind the value note wad 68 so that access to the transport path is prevented by the sliding plate 120. As a result, the insertion of manipulation modules is prevented. One common manipulation attempt is to insert fork clamps to thus hold notes of value and thus to gain possession of these notes of value in an unauthorized manner. By arranging the sliding plate 120 directly behind the value note wad 68, the insertion of such fork clamps is prevented or at least made more difficult.

In addition, the sliding plate 120 can also be used independent of the transport and the offering of this value note wad 68 in order to check whether a fork clamp or a similar module has been inserted into the input and/or output compartment 28. For this, a non-illustrated control unit drives the second transport unit 24 such that the sliding plate 120 is moved into the input and/or output compartment 28. If this is possible without difficulty, it is assumed that no fork clamp has been inserted into the input and/or output compartment 28 since otherwise the movement of the sliding plate 120 would have been impeded thereby. Thus, the proper condition of the device 10 can be checked at any time.

The afore-described second transport unit 24 can generally also be used independent of the other aspects of the head module 12, in particular of the described switch arrangement. In particular, a corresponding transport unit 24, in which a double belt arrangement 100 and a sliding plate 120 movable over the entire distance independent of the double belt arrangement are used, can be inserted into all devices for handling value note wads.

Figure 8:
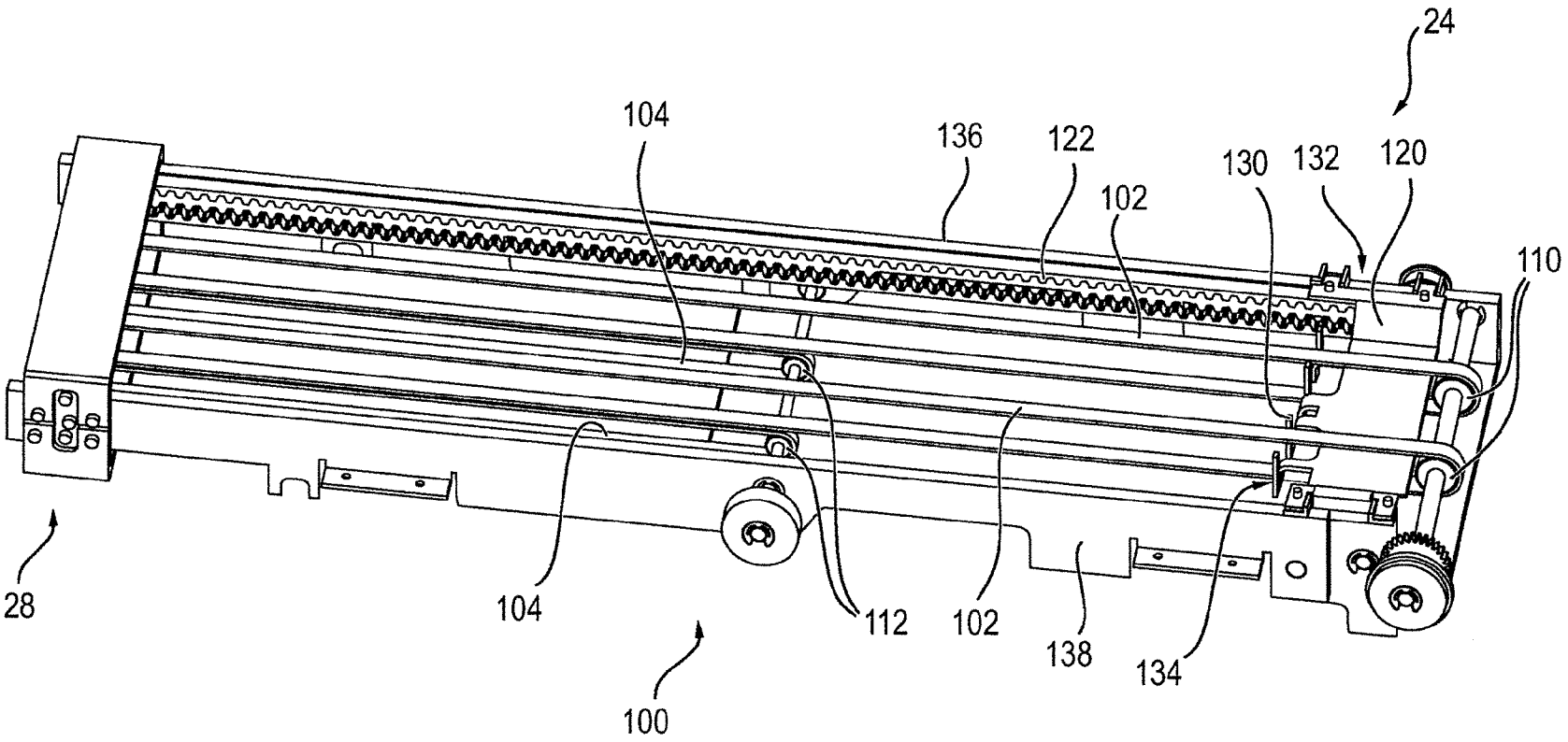
FIG. 8 shows a perspective illustration of the second transport unit according to a fourth embodiment in a first operating state.
Figure 9:
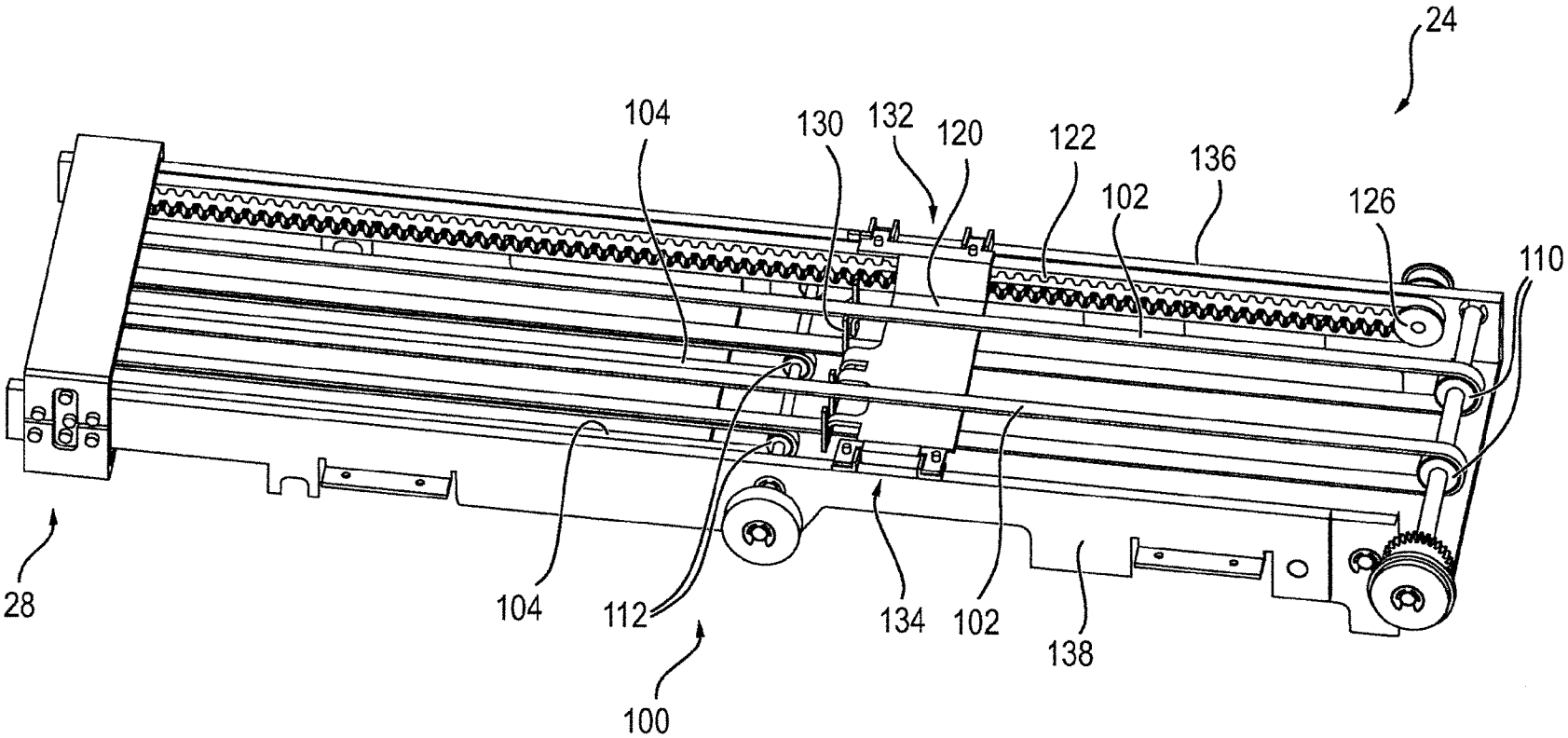
FIG. 9 shows a perspective illustration of a second transport unit according to the fourth embodiment in a second operating state.
Figure 10:
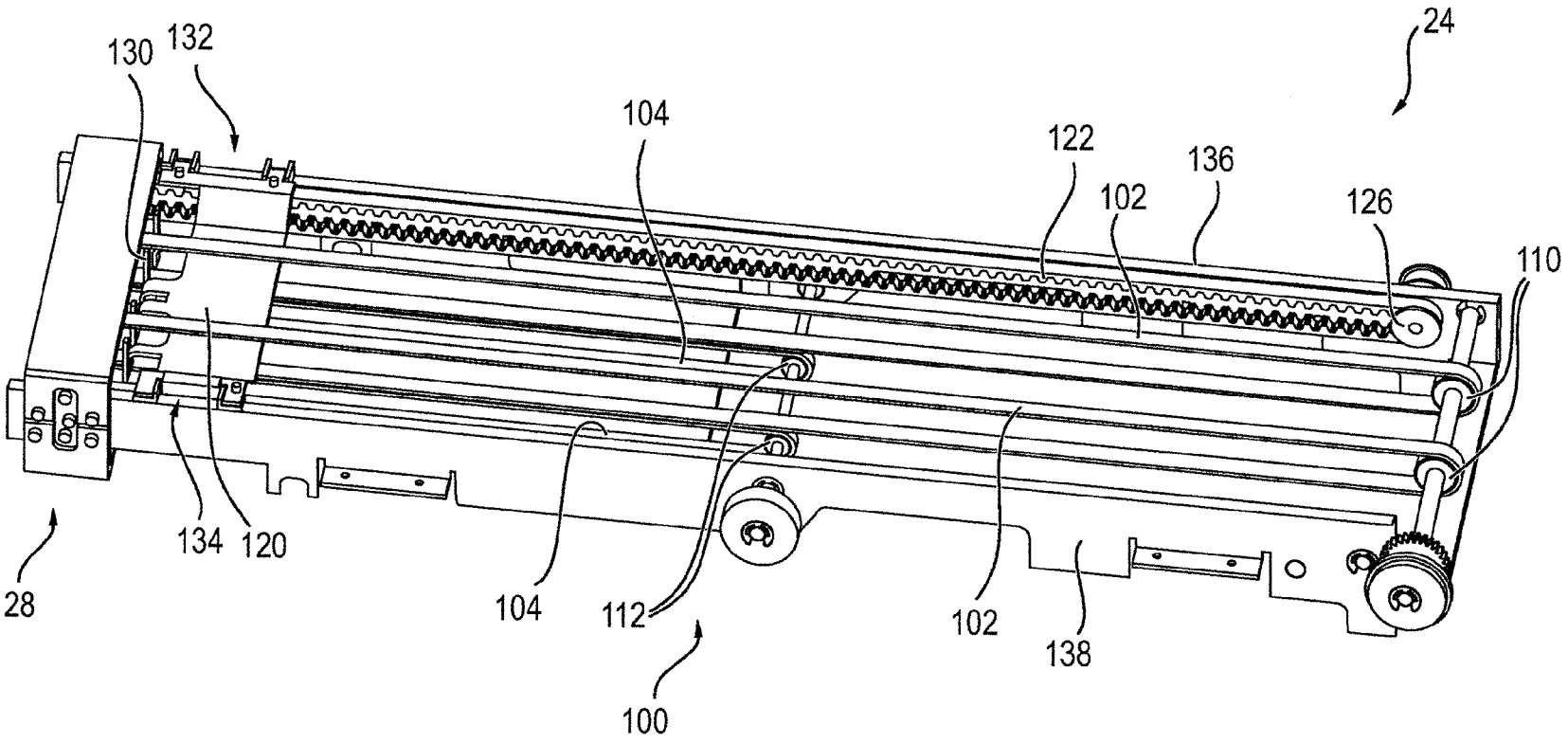
FIG. 10 shows a perspective illustration of the second transport unit according to the fourth embodiment in a third operating state.

In FIGS. 8 to 10, each time a perspective illustration of the second transport unit 24 according to a fourth embodiment is illustrated in different operating states. Elements having the same structure or the same function are identified with the same reference signs.

The double belt arrangement 100 comprises two parallel running first belts 102 as well as two second belts 104 likewise running in parallel. As a result, it is achieved that the notes of value of the value note wad 68 are guided at two points so that a safe transport of the value note wad 68 is possible.

At its end regions 132, 134, the sliding plate 120 is movably mounted on two rails 136, 138. The rails 136, 138 at the same time serve as a lateral casing of the second transport unit 24 and in particular serve to protect the value note wad 68 to be transported against unauthorized access.

At the first end region 132, the sliding plate 120 is attached to a toothed belt 122 which can be driven independent of the belts 102, 104 of the double belt arrangement 100 so that accordingly the sliding plate 120 can be moved independently of the double belt arrangement 100.

The sliding plate 120 comprises a plurality of fingers, one of which being exemplarily identified with the reference sign 130. By means of these fingers 130, the sliding plate 120 presses against the edges of the notes of value for the transport of the notes of value of the value note wad 68. The fingers 130 are in particular designed so long that all notes of value of the value note wad 68 having the maximum admissible number of notes of value to be transported can be contacted by them.

The fingers 130 in particular project into the spaces formed between the parallel running belts 102, 104 and the rails 136, 138 so that there is no collision of the sliding plate 120 with other component parts during the movement of the sliding plate 120.

In the first operating state illustrated in FIG. 8, the sliding plate 120 is arranged at the end of the second transport unit 24 facing away from the input and/or output compartment 28. The sliding plate 120 is in particular arranged in this position, while the notes of value are stacked into the value note wad 68 in the stacking unit 26. After this has been accomplished, the support element 66 is pivoted in the direction of the first belts 102 so that by means of the sliding plate 120 the notes of value are transported out of the stacking unit 26 in the direction of the second belts 104 and thus the value note wad 68 is pressed between the first belts 102 and the second belts 104 of the double belt arrangement 100 by the movement of the sliding plate 120 from the position shown in FIG. 8 into the position shown in FIG. 9.

Subsequently, the value note wad 68 is transported both by the double belt arrangement 100 and by the sliding plate 120 further in the direction of the input and/or output compartment 28. For this, the sliding plate 120 is moved behind the value note wad 68 further in the direction of the input and/or output compartment 28 until it is arranged in the input and/or output compartment 28 in the position shown in FIG. 10.

The sliding plate 120 is in particular moved at a slightly higher speed in the direction of the input and/or output compartment 28 than the belts 102, 104 of the double belt arrangement 100. As a result, it is guaranteed that the sliding plate always presses against the notes of value of the value note wad 68 and thus a fanning-out of the value note wad 68 to be transported is safely prevented.

If a value note wad 68 offered for withdrawal via the input and/or output compartment is not removed, then it is, as already described above, moved back into the reject and retract container 30. Here, the sliding plate 120 is now moved at a slightly slower speed than the belts 102, 104 of the double belt arrangement 100 so that it is in turn likewise guaranteed that the edges of the notes of value of the value note wad rest against the sliding plate 120 and thus a fanning-out is likewise effectively prevented.

As already described in connection with FIG. 7, the sliding plate 120 can also be moved into the position shown in FIG. 10, i.e. into the input and/or output compartment, independent of the transport of a value note wad in order to check whether a manipulation unit, in particular a clamp, has been inserted into the input and/or output compartment 28.

LIST OF REFERENCE SIGNS

10 device
12 head module
14 box area
16 receiving compartment
18 cash box
20 pull-off module
22,24 transport unit
26 stacking unit
28 input and/or output compartment
30 reject and retract container
32, 34 compartment
36,38,40,72,74 belt
42,76 idler element
44,77 guiding element
46,48,56,58,60,62 value note path
50,84,86,90 switch
52 switch element
54 transfer area
64 paddle wheel
66 support element
68 value note wad
70,78 drive unit
82 receiving unit
100 double belt arrangement
102,104,122 belt
106,108,110,112,124,126 pulley
120 sliding plate
130 finger
132, 134 end region
136, 138 rail
P1,P2,P3,P4,P5 direction

The invention claimed is:

1. A device for handling notes of value, comprising a box receiving area (14) for receiving cash boxes (18), a first transport unit (22) for transporting notes of value between a head module (12) of the device (10) and the cash boxes (18) receivable in the box receiving area (24), a first switch (50) arranged at the head module side-end of the first transport unit (22), a stacking unit (26) for stacking the notes of value removed from the cash boxes (18) into a value note wad (68), an input and/or output compartment (28) for the output and/or input of notes of value, a reject and retract container (30) for receiving rejected and non-removed notes of value, and comprising a second transport unit (24) for transporting notes of value between the stacking unit (26), the input and/or output compartment (28) and the reject and retract container (30), wherein the first switch (50) in a first switch position feeds a note of value removed from a cash box (18) to the stacking unit (26) and in a second switch position feeds a note of value removed from a cash box (18) to the second transport unit (24), the second transport unit (24) comprises a second switch (84) for feeding notes of value transported by the second transport unit (24) to the reject and retract container (30), and the second switch (84) is configured so that both rejected notes of value and notes of value not removed from the input and/or output compartment (28) are feedable to the reject and retract container (30), and the reject and retract container (30) further having a third switch (90) for distributing the notes of value fed by the second switch (84) to the first compartment (32) and the second compartment (34).

2. The device (10) of claim 1, wherein the second transport unit (24) is designed for transporting both value note wads (68) and individual notes of value.

3. The device (10) of claim 1, wherein the reject and retract container (30) comprises a first compartment (32) for receiving rejected notes of value and a second compartment (34) separate from the first compartment (32) for receiving non-removed notes of value.

4. The device (10) of claim 1, wherein the stacking unit (26) is arranged in a first end region of the second transport unit (24), the input and/or output compartment (28) is arranged in a second end region of the transport unit (24) opposite to the first end region, and that the reject and retract container (30) is arranged between the stacking unit (26) and the input and/or output compartment (30).

5. The device (10) of claim 1, wherein the first transport unit (22) and the second transport unit (24) are designed such that in a transfer area (54) notes of value are directly transferrable from the first transport unit (22) to the second transport unit (24).

6. The device (10) of claim 1, wherein the stacking unit (26) is designed such that a value note wad (68) stacked therein is feedable from the stacking unit (26) directly to the second transport unit (24).

7. The device (10) of claim 6, wherein the stacking unit (26) comprises a pivotable support element (66) that is movable between a feed position in which the pivotable support element (62) is arranged during the stacking of the fed notes of value into the value note wad (68) and a removal position in which the pivotable support element (66) is arranged for the transfer of the value note wad (68) to the second transport unit (24).

8. The device (10) of claim 1, wherein the second transport unit (24) comprises at least one belt (72, 74) guided over a drivable idler element (76).

9. The device (10) of claim 8, wherein the belt (72, 74) is driven in a first direction of rotation for the transport of notes of value from the stacking unit (26) to the input and/or output compartment (28), for transporting individual rejected notes of value removed from the cash boxes (18) to the reject and retract container (30), and for transporting a rejected value note wad (68) from the stacking unit (26) to the reject and retract container (30).

10. The device (10) of claim 9, wherein the belt (72, 74) is driven in a second direction of rotation opposite to the first direction of rotation for the transport of notes of value not removed from the input and/or output compartment (28) to the reject and retract container (30).

11. The device (10) of claim 1, wherein the second transport unit (24) comprises a receiving unit (82) for receiving a value note wad (68) for the transport of the value note wad (68) from the stacking unit to the input and/or output compartment (28) and/or to the reject and retract container (30).

12. The device (10) of claim 11, wherein a control unit of the device (10) for controlling the input and/or output compartment (28) drives the second transport unit (24) such that the sliding plate (120) is moved into the input and/or output compartment (28).

13. The device (10) of claim 1, wherein the second transport unit (24) comprises a sliding plate (120) for the transport of the value note wad (68) from the stacking unit (26) to the input and/or output compartment (28) and/or to the reject and retract container (30), the sliding plate (120) pressing against the edges of the notes of value of the value note wad (68) for the transport of the value note wad (68) so that the value note wad (68) is moved.

14. The device (10) of claim 13, wherein the sliding plate (120) is movable from the stacking unit (26) up into the input and/or output compartment (28).

15. A device (10) for handling notes of value, comprising:

a box receiving area (14) for receiving cash boxes (18), a first transport unit (22) for transporting notes of value between a head module (12) of the device (10) and the cash boxes (18) receivable in the box receiving area (24), a first switch (50) arranged at the head module side-end of the first transport unit (22), a stacking unit (26) for stacking the notes of value removed from the cash boxes (18) into a value note wad (68), an input and/or output compartment (28) for the output and/or input of notes of value, a reject and retract container (30) for receiving rejected and non-removed notes of value, and a second transport unit (24) for transporting notes of value between the stacking unit (26), the input and/or output compartment (28) and the reject and retract container (30), wherein the first switch (50) in a first switch position feeds a note of value removed from a cash box (18) to the stacking unit (26) and in a second switch position feeds a note of value removed from a cash box (18) to the second transport unit (24), the second transport unit (24) further has a second switch (84) for feeding notes of value transported by the second transport unit (24) to the reject and retract container (30), the second switch (84) is operative so that only rejected notes of value removed from the cash boxes (18) are feedable to the first compartment (32), and the second transport unit (24) further has a fourth switch (86) for feeding notes of value not removed from the input and/or output compartment (28) to the second compartment (34).

16. A device (10) for handling notes of value, comprising:

a box receiving area (14) for receiving cash boxes (18), a first transport unit (22) for transporting notes of value between a head module (12) of the device (10) and the cash boxes (18) receivable in the box receiving area (24), a first switch (50) arranged at the head module side-end of the first transport unit (22), a stacking unit (26) for stacking the notes of value removed from the cash boxes (18) into a value note wad (68), an input and/or output compartment (28) for the output and/or input of notes of value, a reject and retract container (30) for receiving rejected and non-removed notes of value, and a second transport unit (24) for transporting notes of value between the stacking unit (26), the input and/or output compartment (28) and the reject and retract container (30), the second transport unit (24) having a sliding plate (120) for the transport of the value note wad (68) from the stacking unit (26) to the input and/or output compartment (28) and/or to the reject and retract container (30), the sliding plate (120) pressing against edges of the notes of value of the value note wad (68) for the transport of the value note wad (68) so that the value note wad (68) is moved, the second transport unit (24) having at least one double belt arrangement (100) for transporting the value note wad (68), the double belt arrangement (100) comprising at least one first belt (102) and one second belt (104) between which the value note wad (68) is received for transport, the second transport unit (24) further having a sliding plate (120) opposed to edges of the notes of value of the value note wad (68) as the value note wad (68) is being moved from the stacking unit (26) to the input and/or output compartment (28) and/or to the reject and retract container (30) by the double belt arrangement (100) to prevent any of the notes of value from slipping out of the value note wad (68), wherein the first switch (50) in a first switch position feeds a note of value removed from a cash box (18) to the stacking unit (26) and in a second switch position feeds a note of value removed from a cash box (18) to the second transport unit (24).

17. The device (10) of claim 16, wherein the second transport unit (24) comprises a second switch (84) for feeding notes of value transported by means of the second transport unit (24) to the reject and retract container (30).

18. The device (10) of claim 17, wherein the second switch (84) is configured so that both rejected notes of value and notes of value not removed from the input and/or output compartment (28) are feedable to the reject and retract container (30), and that within the reject and retract container (30) a third switch (90) for distributing the notes of value fed by the second switch (84) to the first compartment (32) and the second compartment (34) is provided.

19. The device (10) of claim 16, wherein the value note wad (68) is guided during the transport from the stacking unit (26) to the input and/or output compartment (28) at least over a partial distance both by the double belt arrangement (100) and by the sliding plate (120).

20. The device (10) of claim 16, wherein the value note wad (68) is moved during the transport from the stacking unit (26) to the input and/or output compartment (28) at least over a partial distance by the double belt arrangement (100), and that the sliding plate (120) is moved at least over this partial distance at a predetermined distance behind the rear edge of the value note wad (68), as viewed in the transport direction of the value note wad (68).

21. The device (10) of claim 16, wherein the sliding plate (120) is arranged behind a value note wad (68) to be output when offering the value note wad (68) for the removal from the input and/or output compartment (20).

22. The device (10) of claim 16, wherein the sliding plate (120) is movable independent of the belts (102, 104) of the double belt arrangement (100).

23. The device (10) of claim 22, wherein the sliding plate (120) is attached to a third belt (122), the third belt (122) being a toothed belt that is drivable by a first drive unit, and that the belts (102, 104) of the double belt arrangement (100) are drivable by a second drive unit different from the first drive unit.

24. The device (10) of claim 22, wherein the sliding plate (120) is moved during the transport of a value note wad (68) from the stacking unit (26) to the input and/or output compartment (28) at a higher speed in the direction of the input and/or output compartment (28) than the belts (102, 104) of the double belt arrangement (100).

25. The device (10) claim 22, wherein the sliding plate (120) is moved during the transport of the value note wad (68) from the input and/or output compartment (28) in the direction of the stacking unit (26) at a slower speed in the direction of the stacking unit (28) than the belts (102, 104) of the double belt arrangement (100).

* * * * *